US011757231B2

(12) United States Patent
Yu et al.

(10) Patent No.: US 11,757,231 B2
(45) Date of Patent: Sep. 12, 2023

(54) TWO-STAGE CONNECTOR WITH INTERNAL TERMINAL CORRECTION AND REPAIR

(71) Applicant: DELL PRODUCTS, LP, Round Rock, TX (US)

(72) Inventors: Wei-Cheng Yu, New Taipei (TW); Robert D. Widenhofer, Austin, TX (US); Chi-Che Wu, Taipei (TW)

(73) Assignee: Dell Products L.P., Round Rock, TX (US)

( * ) Notice: Subject to any disclaimer, the term of this patent is extended or adjusted under 35 U.S.C. 154(b) by 273 days.

(21) Appl. No.: 17/064,821

(22) Filed: Oct. 7, 2020

(65) Prior Publication Data

US 2022/0109272 A1 Apr. 7, 2022

(51) Int. Cl.
*H01R 13/631* (2006.01)
*H01R 13/502* (2006.01)

(52) U.S. Cl.
CPC ..... *H01R 13/631* (2013.01); *H01R 13/502* (2013.01)

(58) Field of Classification Search
CPC .. H01R 13/631; H01R 13/502; H01R 24/005; H01R 43/26; H01R 31/06
See application file for complete search history.

(56) References Cited

U.S. PATENT DOCUMENTS

| | | | | |
|---|---|---|---|---|
| 8,562,369 | B2 | 10/2013 | Wu | |
| 9,887,474 | B2 * | 2/2018 | Chien | H01R 13/424 |
| 9,941,631 | B1 * | 4/2018 | Taira | H01R 13/6273 |
| 10,581,210 | B2 | 3/2020 | Pogash et al. | |
| 2014/0099818 | A1 * | 4/2014 | Endo | H01R 13/629 439/378 |
| 2014/0242824 | A1 * | 8/2014 | Karadimas | H01R 13/53 439/181 |
| 2018/0278000 | A1 * | 9/2018 | Regnier | H01R 12/721 |
| 2020/0036142 | A1 * | 1/2020 | Pogash | H01R 13/741 |
| 2020/0099150 | A1 * | 3/2020 | Amini | H01R 12/735 |
| 2020/0106217 | A1 * | 4/2020 | Liu | H01R 13/26 |
| 2021/0367382 | A1 * | 11/2021 | Kim | H01R 13/6585 |
| 2022/0109272 | A1 * | 4/2022 | Yu | H01R 24/005 |

* cited by examiner

*Primary Examiner* — Abdullah A Riyami
*Assistant Examiner* — Nader J Alhawamdeh
(74) *Attorney, Agent, or Firm* — Larson Newman, LLP

(57) ABSTRACT

A connector includes a receptacle and a plug. The receptacle includes a first terminal of a first gender. The plug includes a second terminal of a second gender opposite to the first gender. The plug further includes a cover and an insert. The cover plugs into the receptacle. The insert includes the second terminal. The insert inserts into the cover such that the first terminal makes an electrical connection with the second terminal.

20 Claims, 8 Drawing Sheets

200

200

200

200

TWO-STAGE CONNECTOR WITH INTERNAL TERMINAL CORRECTION AND REPAIR

FIELD OF THE DISCLOSURE

This disclosure generally relates to information handling systems, and more particularly relates to interconnects within an information handling system.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

SUMMARY

A connector may include a with a first terminal of a first gender, and a plug may include a second terminal of a second gender opposite to the first gender. The plug may further include a cover and an insert. The cover may plug into the receptacle. The insert may include the second terminal. The insert may insert into the cover such that the first terminal makes an electrical connection with the second terminal.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings can certainly be used in this application. The teachings can also be used in other applications, and with several different types of architectures, such as distributed computing architectures, client/server architectures, or middleware server architectures and associated resources.

Figure 1:
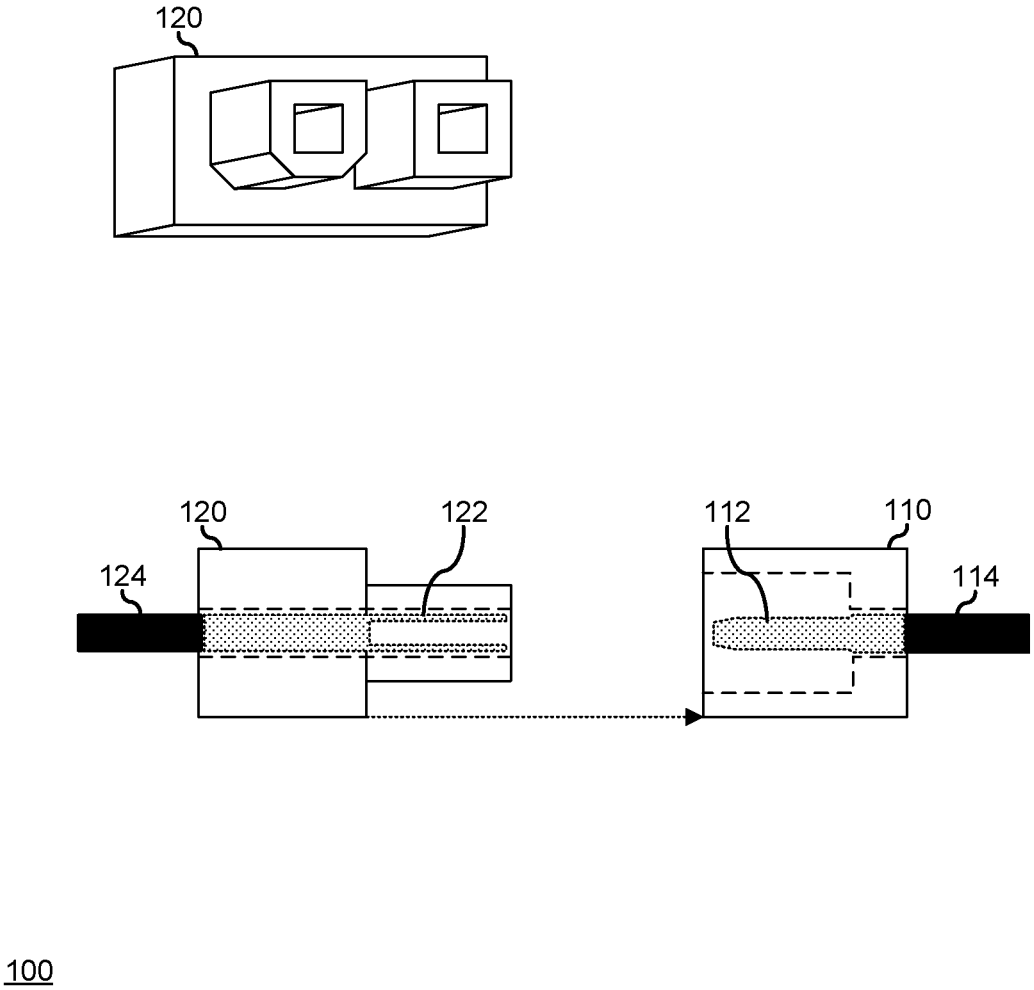
FIG. 1 (Prior Art)
FIG. 1 is a diagram of an electrical connector according to the prior art.

FIG. 1 illustrates a connector system 100, including a connector receptacle 110 and a connector plug 120. Connector receptacle 110 includes a male terminal 112 and a wire 114 connected to the male terminal. Connector plug 120 includes a female terminal 122 and a wire 124 connected to the female terminal. Connector system 100 represents a connector for making electrical connections between circuit elements that are connected to connector receptacle 110 via wire 114 and circuit elements that are connected to connector plug 120 via wire 124. Note that, as illustrated, connector receptacle 110 and connector plug 120 represent a cable-based connector system. In this regard, connector system 100 is illustrative, and the teachings as found herein are not intended to be limited to the particular case of cable-based connectors. In particular, one or more of connector receptacle 110 and connector plug 120 may be understood to be cable-based connector elements, to be rigid mounted connector elements that are mounted to a printed circuit board (PCB) or other rigid mounting elements, or to be otherwise connected to various circuit elements as represented by wires 114 and 124. Further note that connector plug 120 is illustrated in a perspective view as having two terminal locations. In this regard, both connector plug 120 and connector receptacle 110 will be understood to each have two complimentary terminal locations. Moreover, connector receptacle 110 will thus be understood to include two male terminals 112, one at each terminal location, and connector plug 120 will be understood to include two female terminals 122. In this regard, further, connector system 100 is illustrative, and the teachings as found herein are not intended to be limited to the particular case of two-terminal connector systems. As such, connector system 100 may represent other numbers of contact locations, arranged in any configuration, as needed or desired.

Connector receptacle 110 is configured to receive connector plug 120 in such a way as to align male terminal 112 and female terminal 122 to make a good, low resistance, connection between the male and female terminals. It will be understood that a connector receptacle similar to connector receptacle 110 may include female terminals instead of male terminals, and that a connector plug similar to connector plug 120 may include complimentary male terminals instead of female terminals, as needed or desired. As illustrated, connector plug 120 includes one terminal location that is keyed so as to prevent the connector plug from being plugged into connector receptacle 110 in an incorrect orientation. Note that, for example, a connector system with two terminal locations may be configured to provide a similar alignment mechanism by providing a connector receptacle having a first terminal location with a male terminal and a second terminal location with a female terminal. Here, the associated connector plug will be understood to include a female terminal in the first location and a male terminal in the second location. Connector system 100 may include other elements, such as a locking mechanism for retaining connector receptacle 110 and connector plug 120 firmly together when plugged in, additional keying features, mounting features, and the like, as needed or desired.

The inventors of the current invention have understood that ensuring good contact between male terminals and their associated female terminals results in lower overall terminal resistance. Further, balancing the resistances between the points of contact between male terminals and their associated female terminals increases the reliability of the connections made thereby, providing improved power supply unit efficiency, increased reliability. Moreover, where good contact between male terminals and their associated female terminals is assured, the need to use high conductivity materials, such as alloy bronze, in the fabrication of the male and female terminals is mitigated, and lower conductivity materials, such as phosphor bronze, may be used in the fabrication of the male and female terminals, thereby decreasing the cost of the associated connector systems.

However, the inventors of the current invention have further understood that the repeated cycle of connection and disconnection of a connector system degrades the quality of the contact between the male and female terminals of the connector system. In particular, male terminals and female terminals are typically formed of a single piece of metal, and are thus susceptible to deformation of the female terminals with the repeated insertion and de-insertion of male terminals into the female terminals. This is because the alignment of the terminals may not always be assured. Inserting a male terminal into a female terminal at an angle may result in widening the opening of the female terminal, such that subsequent insertions provide insufficient wiping of oxides from the contact surfaces of the terminals, leading to point contacts between the terminals that have different resistances. For example, where a female terminal includes four contact points that are intended fit snugly and wipe corrosion from the associated male terminal, a deformed female terminal may result on only one or two of the contact points providing low (good) resistance connections, while the remaining contact points exhibit higher (bad) resistance connections. In this example, a higher proportion of the current will be carried by the high resistance contact points, which may lead to overheating of the terminals, with possible disastrous consequences (e.g., melting or burning the connector, the wires connected thereto, or both). This problem is exacerbated by the understanding that, in a typical manufacturing process, a connector may be subject to up to 15 or more cycles of connections and disconnections: 2-3 insertions in wire harness or PCB assembly, 5-10 insertions in PSU manufacturing, 2-3 insertions in final system assembly, etc.)

Figure 2:
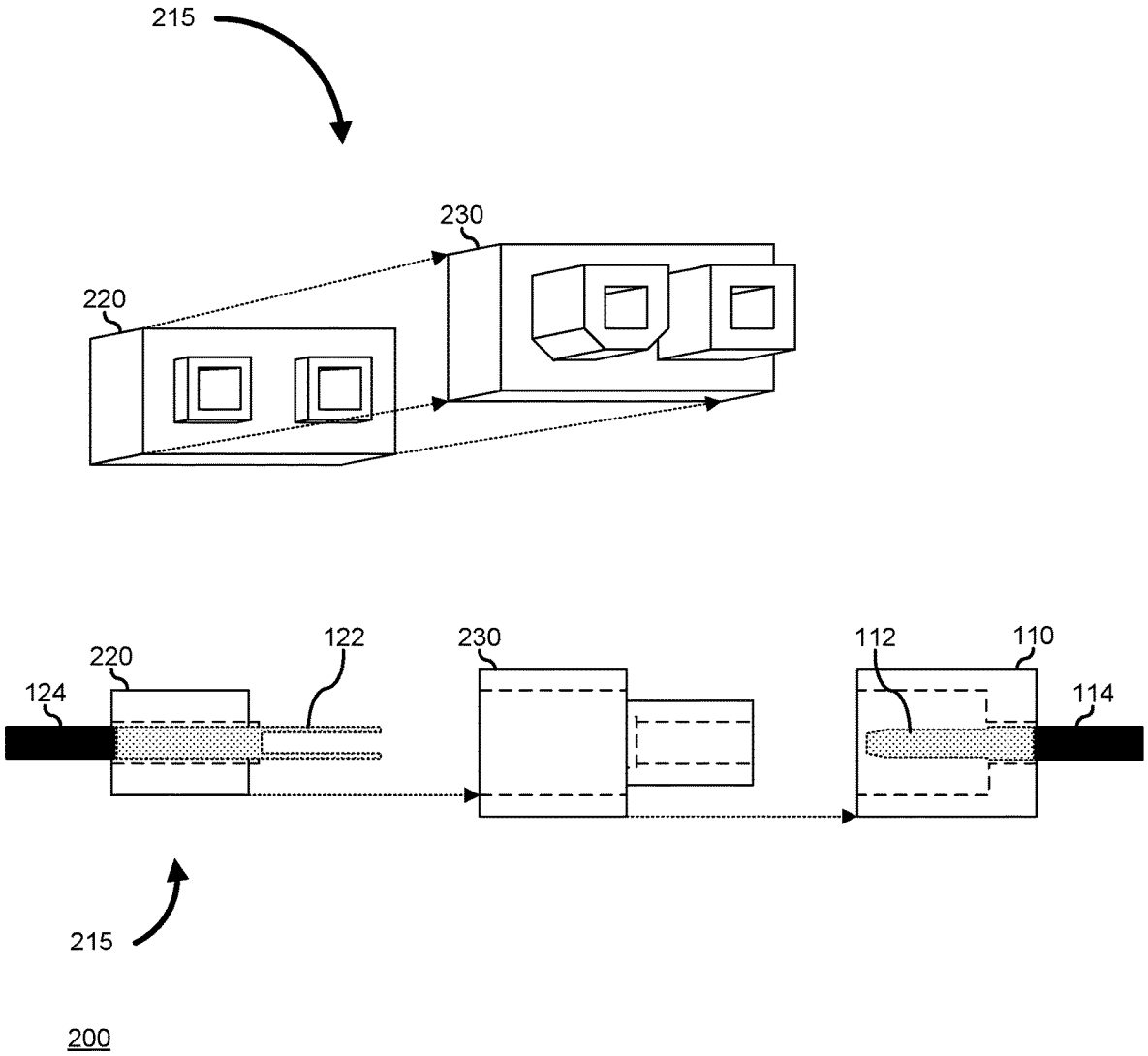
FIG. 2 is a diagram of an electrical connector according to an embodiment of the current disclosure.

FIG. 2 illustrates a connector system 200, including a connector receptacle 110 and a connector plug 215. Connector receptacle 110 includes a male terminal 112 and a wire 114 connected to the male terminal, and represents the same connector receptacle 110 as is utilized in connector system 100. As such, connector plug 215 is similar to connector plug 120 in terms of overall function and features, and includes female terminal 122 and wire 124 connected to the female terminal. Here, connector plug 215 differs from connector plug 120 as described below. Connector system 200 represents a connector for making electrical connections between circuit elements that are connected to connector receptacle 110 via wire 114 and circuit elements that are connected to connector plug 120 via wire 124. Note that, as illustrated, connector receptacle 110 and connector plug 215 represent a cable-based connector system. In this regard, connector system 200 is illustrative, and the teachings as found herein are not intended to be limited to the particular case of cable-based connectors. In particular, one or more of connector receptacle 110 and connector plug 215 may be understood to be cable-based connector elements, to be rigid mounted connector elements that are mounted to a printed circuit board (PCB) or other rigid mounting elements, or to be otherwise connected to various circuit elements as represented by wires 114 and 124. Further note that connector plug 215 is illustrated in a perspective view as having two terminal locations. In this regard, both connector plug 215 and connector receptacle 110 will be understood to each have two complimentary terminal locations. Moreover, connector receptacle 110 will thus be understood to include two male terminals 112, one at each terminal location, and connector plug 215 will be understood to include two female terminals 122. In this regard, further, connector system 200 is illustrative, and the teachings as found herein are not intended to be limited to the particular case of two-terminal connector systems. As such, connector system 200 may represent other numbers of contact locations, arranged in any configuration, as needed or desired.

Connector receptacle 110 is configured to receive connector plug 215 in such a way as to align male terminal 112 and female terminal 122 to make a good, low resistance, connection between the male and female terminals. It will be understood that a connector receptacle similar to connector receptacle 110 may include female terminals instead of male terminals, and that a connector plug similar to connector plug 215 may include complimentary male terminals instead of female terminals, as needed or desired. As illustrated, connector plug 215 includes one terminal location that is keyed so as to prevent the connector plug from being plugged into connector receptacle 110 in an incorrect orientation. Note that, for example, a connector system with two terminal locations may be configured to provide a similar alignment mechanism by providing a connector receptacle having a first terminal location with a male terminal and a second terminal location with a female terminal. Here, the associated connector plug will be understood to include a female terminal in the first location and a male terminal in the second location. Connector system 200 may include other elements, such as a locking mechanism for retaining connector receptacle 110 and connector plug 215 firmly together when plugged in, additional keying features, mounting features, and the like, as needed or desired. Thus, connector plug 215 will be understood to be interchangeable with connector plug 120, as needed or desired. Connector plug 215 includes an insert 220 and a cover 230. Insert 220 is configured to retain female terminal 122 and wire 124, and to be plugged in to cover 230, and the cover is configured to be plugged in to connector receptacle 110, as described below.

Prior to the insertion of connector plug 215 into connector receptacle 110, female terminal 122 is affixed to wire 124, typically by a crimping or soldering process, and then the female terminal is installed into insert 220. Here, female terminal 122 may include one or more retainer mechanism that ensures that, when installed into insert 220, the female terminal does not move with respect to the insert. For example, a crimped portion of female terminal 122 may have a wider diameter than a portion that connects to male terminal 112. In this way, female terminal 122 may be prevented from being installed into insert 220 further than a desired distance. Then, when installed into insert 220 the desired distance, the retainer mechanisms can engage with a front side of the insert to prevent female terminal 122 from being pushed back out of insert 220 when connector plug 215 is inserted into connector receptacle 110. A completed assembly, including all female terminals 122 installed into insert 220, will be henceforth referred to as an insert assembly 225.

Figure 3:
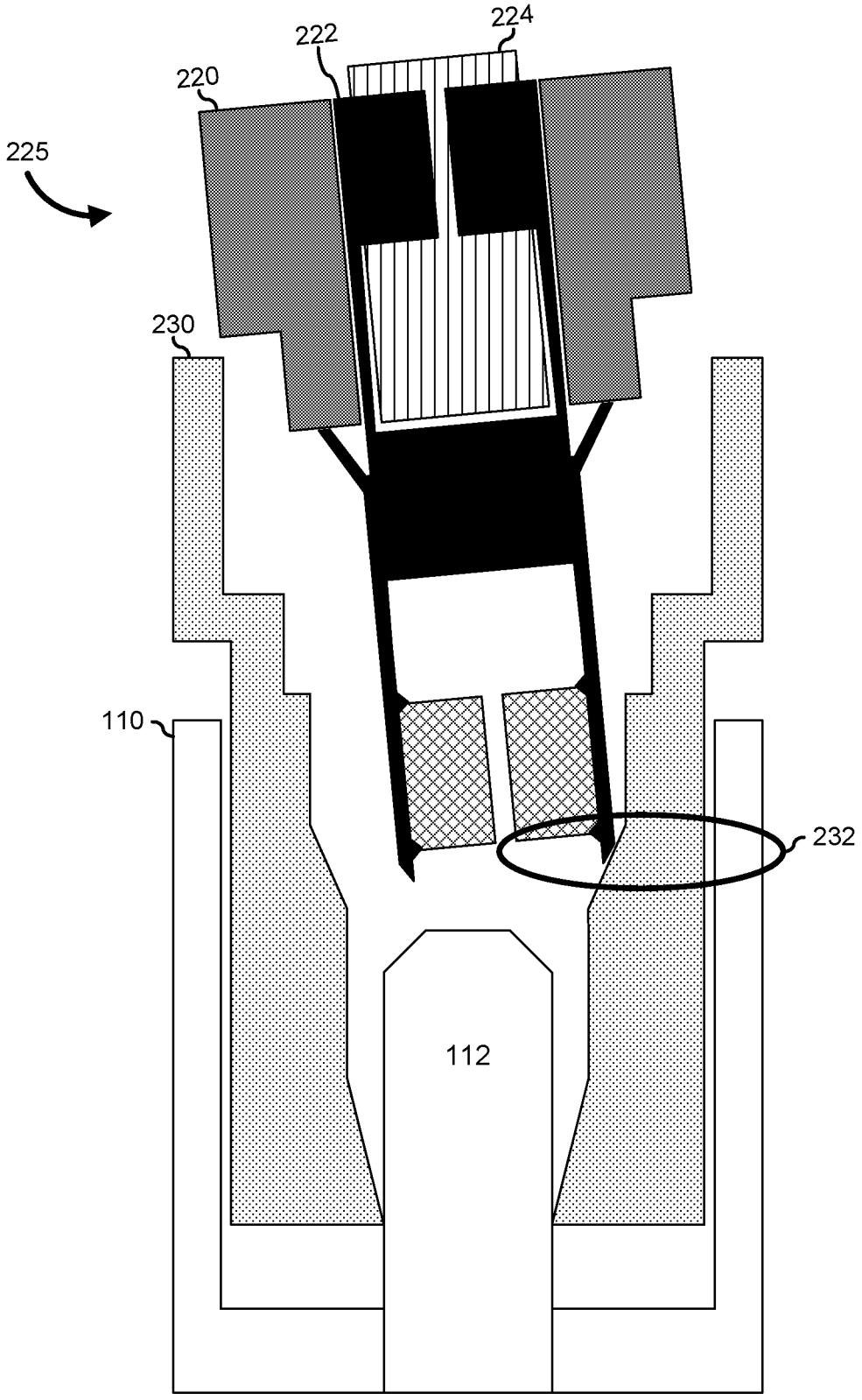
FIGS. 3-5 illustrate a three-stage insertion process for the electrical connector of FIG. 2.
Figure 4:
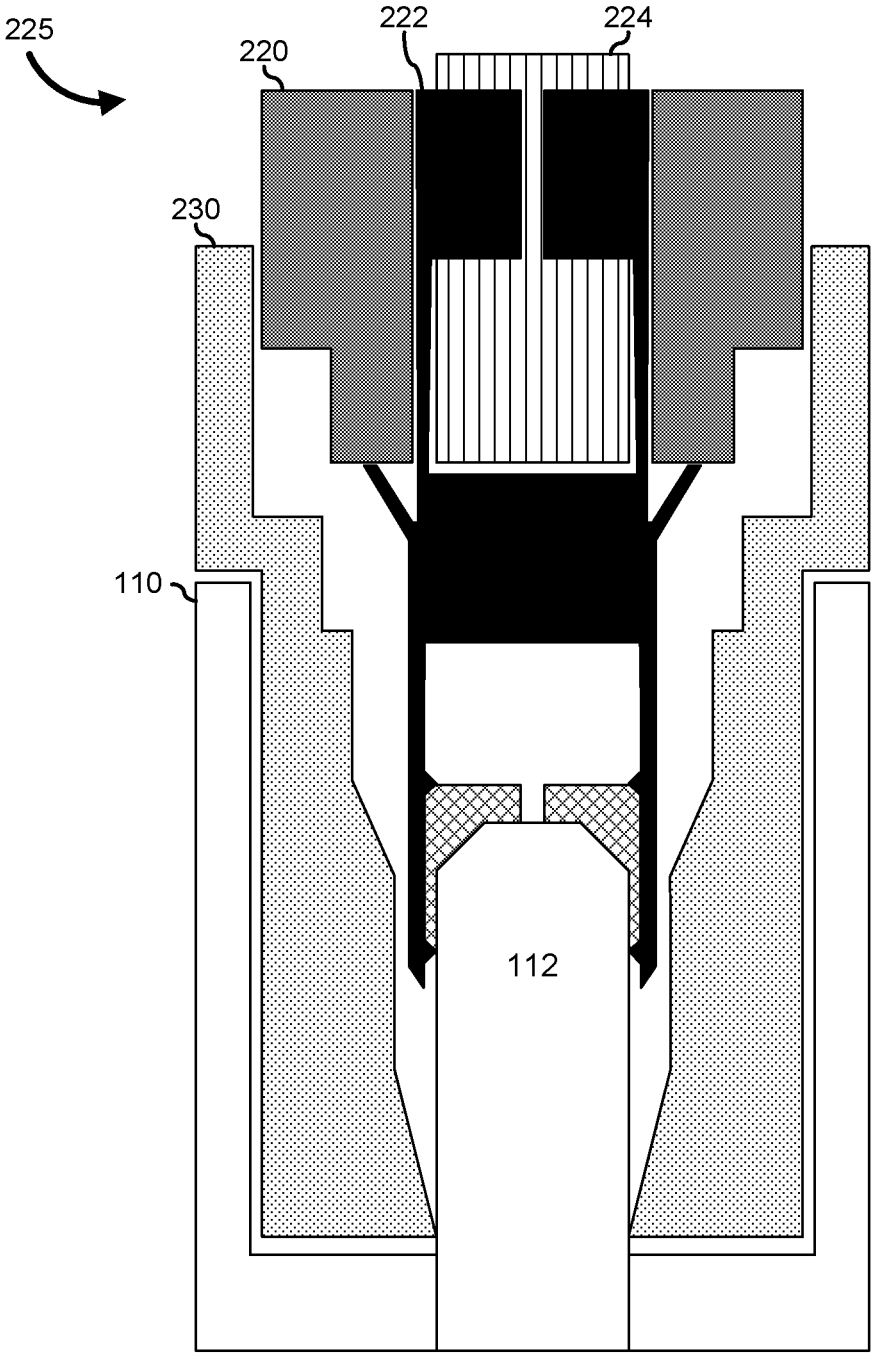
Figure 5:
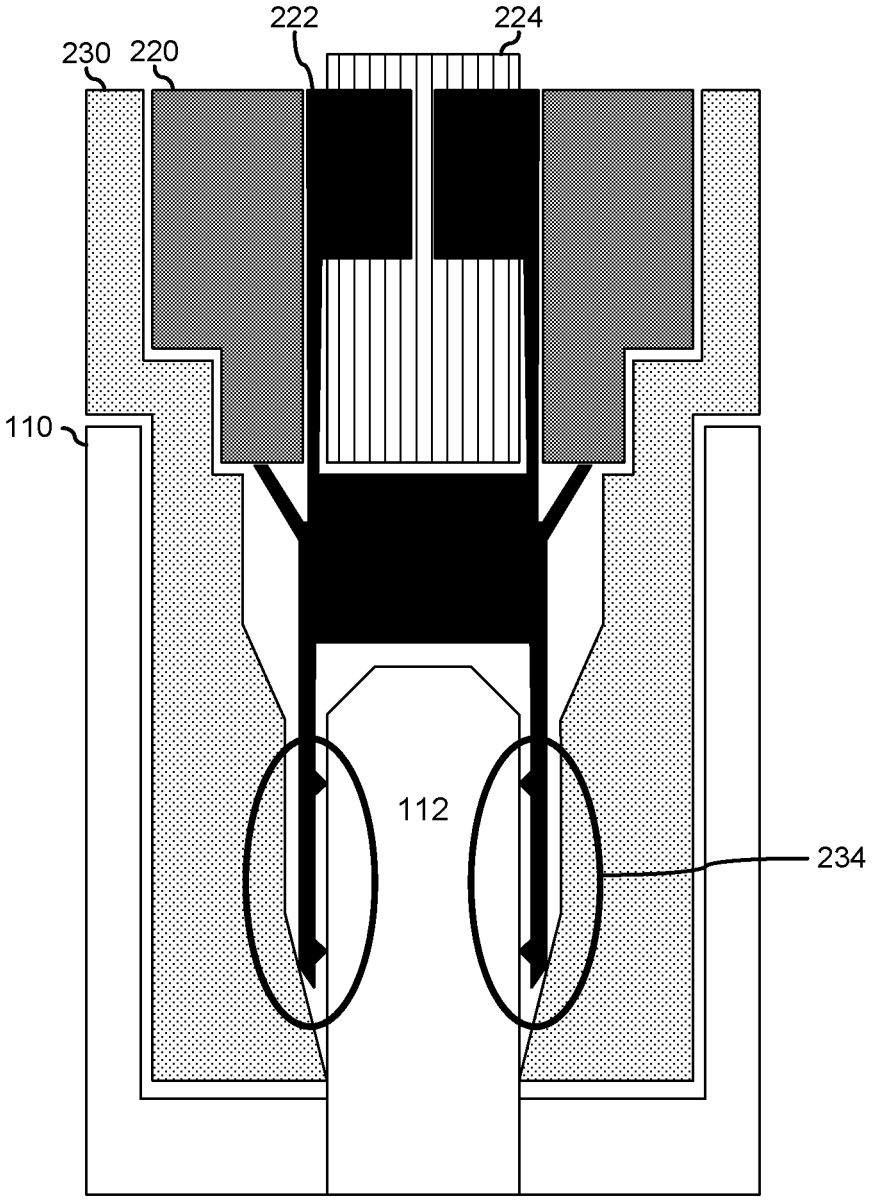

FIGS. 3-5 illustrate a three-stage insertion of connector plug 215 into connector receptacle 110. In FIG. 3, a first stage is shown where cover 230 is partially inserted into connector receptacle 110. The depth of insertion of cover 230 into connector receptacle 110 can be pre-configured, utilizing, for example, a bump-and-detent mechanism, such that a small bump on one of connector receptacle 110 or cover 230 is engaged with a matching detent on the other one of the connector receptacle or the cover, thereby limiting the insertion depth without the exertion of a noticeably greater insertion force on the cover. Here, cover 230 is engaged with male terminal 112, but, because cover 230 is typically fabricated of a thermoplastic material, or the like, any deformation from the insertion process is not done to female terminal 122. Instead, when insert assembly 225 is inserted into cover 230, a first tapered portion 232 provided on an inner surface of the cover operates to guide female terminal 122 into correct alignment with male terminal 112, so as to prevent the deformation of the female terminal. That is, the insertion depth of cover 230 into connector receptacle 110, and the insertion depth of insert assembly 215 into the cover in this first stage are such that female terminal 122 is correctly aligned with male terminal 112 prior to any physical engagement between the female terminal and the male terminal.

In FIG. 4, a second stage is shown where cover 230 is fully inserted into connector receptacle 110. The process of fully inserting cover 230 into connector receptacle 110 results in bringing female terminal 122 into contact with male terminal 112. However, here, the correct angle of insertion of female terminal 122 into male terminal 112 is assured and deformation of the female terminal is prevented.

In FIG. 5, a third stage is shown where insert assembly 215 is fully inserted into cover 220. Here, a second tapered portion 234 on the inner surface of cover 230 operates to compress the contact portions of female terminal 122 into male terminal 112. As the contact portions are compressed to a greater degree as insert assembly 215 is fully inserted into cover 230, such that the contact portions of female terminal 122 make a positive wiping action on the surface of the male terminal. Further, taper portion 234 ensures that all contact portions of female terminal 122 are brought into positive contact with male terminal 112, thereby ensuring that all contact portions provide low resistance connections between the male and female terminals.

Figure 6:
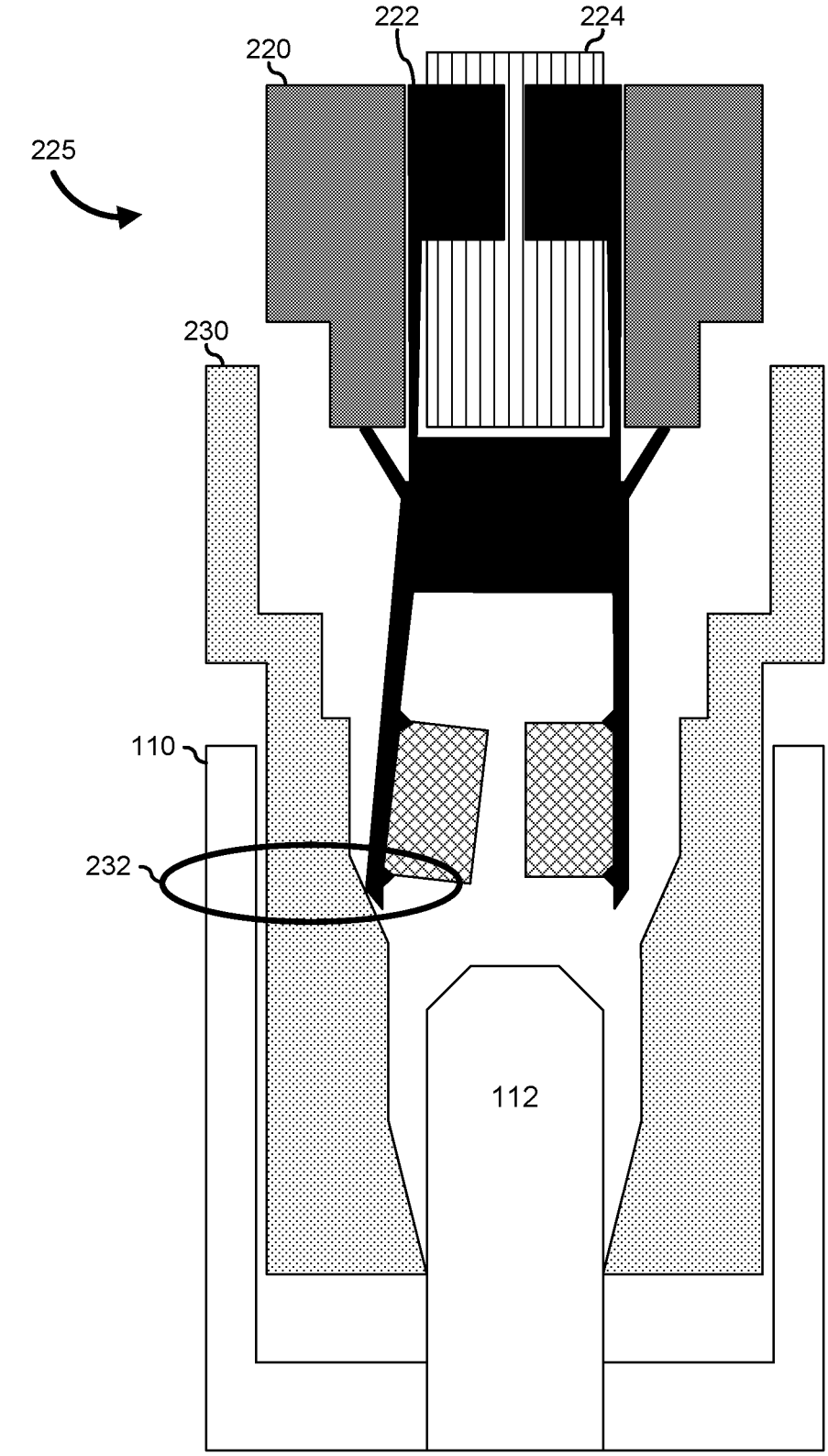
FIG. 6 illustrates a self-healing property of the electrical connector of FIG. 2.

FIG. 6 illustrates a self-healing feature of connector system 200, whereby a deformed female terminal 122 is mended. Here, one side of female terminal 122 is shown as being bent outward, for example due to previous insertions of insert assembly 215 into connector receptacle 110. Here, as insert assembly 5 is inserted into cover 230, the deformed portion of female terminal 122 engages with first tapered portion 232, and the deformation is brought back into correct alignment with male terminal 112. Note that the correction of the deformation of female terminal 122 may be temporary or permanent. For example, the correction of the deformation may be provided by flexing female terminal 122 into the correct alignment, or the correction may be provided by bending the female terminal. Where female terminal 122 is flexed, the correction may be temporary. That is, when insert assembly 215 is removed from cover 230, the deformation of female terminal 122 may still be present. On the other hand, where female terminal 122 is bent, the correction may be permanent. That is, when insert assembly 215 is removed from cover 230, the deformation of female terminal 122 may be permanently corrected. In either case, the deformation has no effect on the final connection, because, when fully inserted into cover 230, the improved contact wiping and the resulting low resistance contacts are assured by the action of second tapered portion 234, as shown in FIG. 5.

Figure 7:
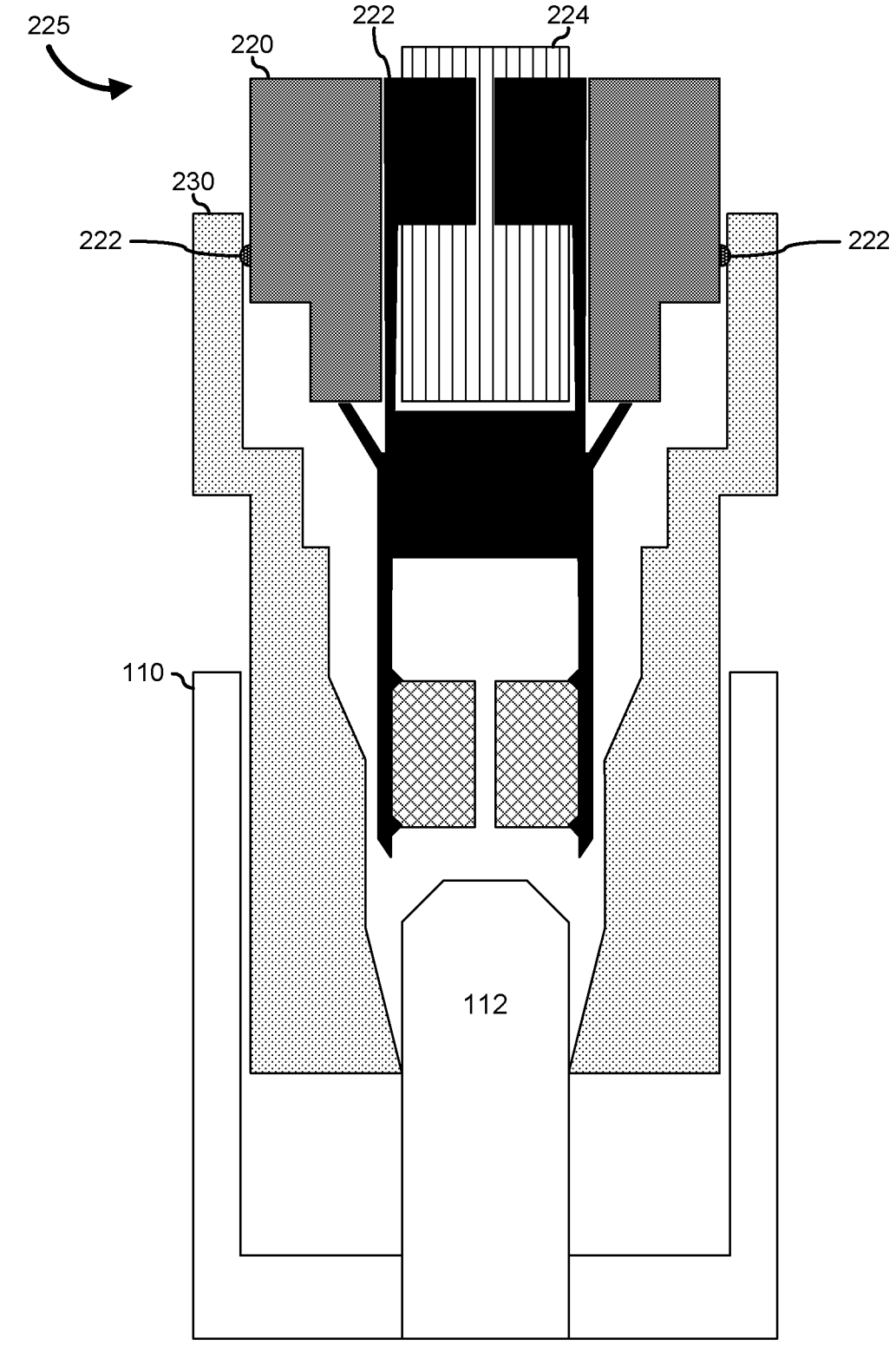
FIG. 7 illustrates a two-stage insertion process for the electrical connector of FIG. 2.

FIG. 7 illustrates a first stage of a two-stage insertion of connector plug 215 into connector receptacle 110. Here, prior to insertion, in a pre-insertion assembly process, insert assembly 215 and cover 230 are semi-rigidly affixed together, such that the insert assembly and the cover are not easily separable. For example, a bump-and-detent mechanism may be employed, such that a small bump on one of insert 220 or cover 230 is engaged with a matching detent on the other one of the insert or the cover, thereby capturing the insert in a partially-inserted state. This example is illustrated by bumps 222 on insert 220 that are engaged with detents on the inner surface of cover 230. In another example, a clip-and-tab mechanism may be employed such that a clip on one of insert 220 or cover 230 is engaged with a matching tab on the other one of the insert or the cover, thereby capturing the insert in a partially-inserted state. Other retainment mechanisms may be utilized, as needed or desired. In any case, the use of such a retainment mechanism permits easy end-use of connector plug 215, in that a component that utilizes the connector plug may ship with the entire connector plug as a ready-made assembly, without having to ensure the availability of extra covers at the time of insertion into connector receptacle 110. Here, in the pre-insertion assembly process, female terminal 122 is assembled such that any misalignment of insert assembly 215 with cover 230 is corrected prior to insertion into connector receptacle 110, the insert assembly having already been inserted past first tapered portion 232. Then, in a first stage of insertion of insert assembly 215 and cover 230 into connector receptacle 110, female terminal 112 is already positioned in correct alignment with male terminal 112. The second stage of the insertion process is similar to the stage depicted in FIG. 5.

Note that FIGS. 3-7 are shown in a cut-away view. However, it will be understood that cover 230 will have an inner surface that has a profile that is matched to the particular configuration of female terminal 122. For example, if female terminal 122 has a circular cross-section then first and second tapered portions 232 and 234 may be conic sections within the inner surface of cover 230. In another example, if female terminal 122 has a square cross-section, then first and second tapered portions 232 and 234 may be representative of multiple flat surfaces (e.g., four flat surfaces) on the inner surface of connector 230, each associated with one of the sides of the female terminal.

Figure 8:
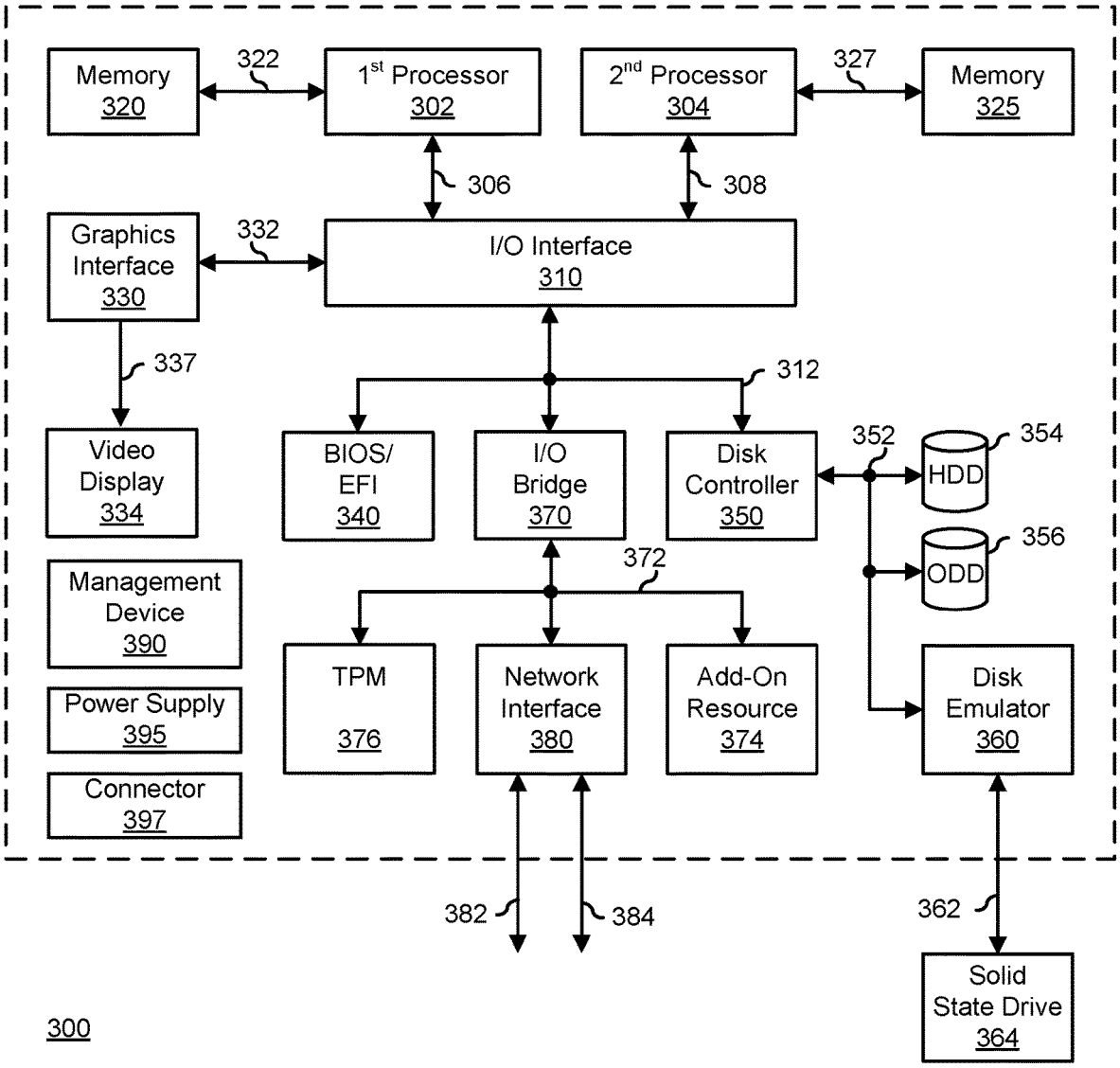
FIG. 8 is a block diagram illustrating a generalized information handling system according to another embodiment of the present disclosure.

FIG. 8 illustrates a generalized embodiment of an information handling system 300 similar to information handling systems 100 and 200. For purpose of this disclosure an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 300 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 300 can include processing resources for executing machine-executable code, such as a central processing unit (CPU), a programmable logic array (PLA), an embedded device such as a System-on-a-Chip (SoC), or other control logic hardware. Information handling system 300 can also include one or more computer-readable medium for storing machine-executable code, such as software or data. Additional components of information handling system 300 can include one or more storage devices that can store machine-executable code, one or more communications ports for communicating with external devices, and various input and output (I/O) devices, such as a keyboard, a mouse, and a video display. Information handling system 300 can also include one or more buses operable to transmit information between the various hardware components.

Information handling system 300 can include devices or modules that embody one or more of the devices or modules described below, and operates to perform one or more of the methods described below. Information handling system 300 includes a processors 302 and 304, an input/output (I/O) interface 310, memories 320 and 325, a graphics interface 330, a basic input and output system/universal extensible firmware interface (BIOS/UEFI) module 340, a disk controller 350, a hard disk drive (HDD) 354, an optical disk drive (ODD) 356, a disk emulator 360 connected to an external solid state drive (SSD) 362, an I/O bridge 370, one or more add-on resources 374, a trusted platform module (TPM) 376, a network interface 380, a management device 390, a power supply 395, and a power supply connector 397. Processors 302 and 304, I/O interface 310, memory 320, graphics interface 330, BIOS/UEFI module 340, disk controller 350, HDD 354, ODD 356, disk emulator 360, SSD 362, I/O bridge 370, add-on resources 374, TPM 376, and network interface 380 operate together to provide a host environment of information handling system 300 that operates to provide the data processing functionality of the information handling system. The host environment operates to execute machine-executable code, including platform BIOS/UEFI code, device firmware, operating system code, applications, programs, and the like, to perform the data processing tasks associated with information handling system 300.

In the host environment, processor 302 is connected to I/O interface 310 via processor interface 306, and processor 304 is connected to the I/O interface via processor interface 308. Memory 320 is connected to processor 302 via a memory interface 322. Memory 325 is connected to processor 304 via a memory interface 327. Graphics interface 330 is connected to I/O interface 310 via a graphics interface 332, and provides a video display output 336 to a video display 334. In a particular embodiment, information handling system 300 includes separate memories that are dedicated to each of processors 302 and 304 via separate memory interfaces. An example of memories 320 and 330 include random access memory (RAM) such as static RAM (SRAM), dynamic RAM (DRAM), non-volatile RAM (NV-RAM), or the like, read only memory (ROM), another type of memory, or a combination thereof.

BIOS/UEFI module 340, disk controller 350, and I/O bridge 370 are connected to I/O interface 310 via an I/O channel 312. An example of I/O channel 312 includes a Peripheral Component Interconnect (PCI) interface, a PCI-Extended (PCI-X) interface, a high-speed PCI-Express (PCIe) interface, another industry standard or proprietary communication interface, or a combination thereof. I/O interface 310 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/UEFI module 340 includes BIOS/UEFI code operable to detect resources within information handling system 300, to provide drivers for the resources, initialize the resources, and access the resources. BIOS/UEFI module 340 includes code that operates to detect resources within information handling system 300, to provide drivers for the resources, to initialize the resources, and to access the resources.

Disk controller 350 includes a disk interface 352 that connects the disk controller to HDD 354, to ODD 356, and to disk emulator 360. An example of disk interface 352 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 360 permits SSD 364 to be connected to information handling system 300 via an external interface 362. An example of external interface 362 includes a USB interface, an IEEE 1394 (Firewire) interface, a proprietary interface, or a combination thereof. Alternatively, solid-state drive 364 can be disposed within information handling system 300.

I/O bridge 370 includes a peripheral interface 372 that connects the I/O bridge to add-on resource 374, to TPM 376, and to network interface 380. Peripheral interface 372 can be the same type of interface as I/O channel 312, or can be a different type of interface. As such, I/O bridge 370 extends the capacity of I/O channel 312 when peripheral interface 372 and the I/O channel are of the same type, and the I/O bridge translates information from a format suitable to the I/O channel to a format suitable to the peripheral channel 372 when they are of a different type. Add-on resource 374 can include a data storage system, an additional graphics interface, a network interface card (NIC), a sound/video processing card, another add-on resource, or a combination thereof. Add-on resource 374 can be on a main circuit board, on separate circuit board or add-in card disposed within information handling system 300, a device that is external to the information handling system, or a combination thereof.

Network interface 380 represents a NIC disposed within information handling system 300, on a main circuit board of the information handling system, integrated onto another component such as I/O interface 310, in another suitable location, or a combination thereof. Network interface device 380 includes network channels 382 and 384 that provide interfaces to devices that are external to information handling system 300. In a particular embodiment, network channels 382 and 384 are of a different type than peripheral channel 372 and network interface 380 translates information from a format suitable to the peripheral channel to a format suitable to external devices. An example of network channels 382 and 384 includes InfiniBand channels, Fibre Channel channels, Gigabit Ethernet channels, proprietary channel architectures, or a combination thereof. Network channels 382 and 384 can be connected to external network resources (not illustrated). The network resource can include another information handling system, a data storage system, another network, a grid management system, another suitable resource, or a combination thereof.

Management device 390 represents one or more processing devices, such as a dedicated baseboard management controller (BMC) System-on-a-Chip (SoC) device, one or more associated memory devices, one or more network interface devices, a complex programmable logic device (CPLD), and the like, that operate together to provide the management environment for information handling system 300. In particular, management device 390 is connected to various components of the host environment via various internal communication interfaces, such as a Low Pin Count (LPC) interface, an Inter-Integrated-Circuit (I2C) interface, a PCIe interface, or the like, to provide an out-of-band (00B) mechanism to retrieve information related to the operation of the host environment, to provide BIOS/UEFI or system firmware updates, to manage non-processing components of information handling system 300, such as system cooling fans and power supplies. Management device 390 can include a network connection to an external management system, and the management device can communicate with the management system to report status information for information handling system 300, to receive BIOS/UEFI or system firmware updates, or to perform other task for managing and controlling the operation of information handling system 300. Management device 390 can operate off of a separate power plane from the components of the host environment so that the management device receives power to manage information handling system 300 when the information handling system is otherwise shut down. An example of management device 390 include a commercially available BMC product or other device that operates in accordance with an Intelligent Platform Management Initiative (IPMI) specification, a Web Services Management (WSMan) interface, a Redfish Application Programming Interface (API), another Distributed Management Task Force (DMTF), or other management standard, and can include an Integrated Dell Remote Access Controller (iDRAC), an Embedded Controller (EC), or the like. Management device 390 may further include associated memory devices, logic devices, security devices, or the like, as needed or desired.

Power supply 395 represents a power converter that receives power from typically an AC power source, and converts the AC power to various DC power rails as needed or desired to operate the elements of information handling system 300. Power supply 395 may represent a modular device that is provided separately from other main components as may be found on a main board or motherboard of information handling system 300. As such, power supply 395 will typically be connected to one or more component of information handling system 300, or to the AC power source via connector 397. Here, connector 397 may utilize one or more of connector systems 100 and 200, as needed or desired. The details of power conversion in a power supply are known in the art and will not be further described herein, except as needed to describe the current embodiments Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A connector, comprising:

a receptacle including a first terminal of a first gender;

a cover configured to plug into the receptacle; and an insert configured to plug into the cover, the insert including a second terminal of a second gender opposite to the first gender, wherein, when the insert is inserted into the cover, the first terminal makes an electrical connection with the second terminal.

2. The connector of claim 1, wherein the cover is further configured to plug into the receptacle in a partially plugged position and in a fully plugged position.

3. The connector of claim 2, wherein, when the cover is in the partially plugged position, the cover is further configured to engage with the first terminal to align the cover with the first terminal.

4. The connector of claim 3, wherein the insert is further configured to insert into the cover in a partially inserted position and in a fully inserted position.

5. The connector of claim 4, wherein the cover includes an inner surface having a first tapered portion to align the second terminal with the first terminal.

6. The connector of claim 5, wherein, when the insert is in the partially inserted position and the cover is in the partially plugged position, the insert is further configured to engage with the first tapered portion to align the second terminal with the first terminal.

7. The connector of claim 5, wherein, when the insert is in the partially inserted position and the cover is in the partially plugged position, the insert is further configured to engage with the first tapered portion to correct at least one of a deformed first terminal and a deformed second terminal.

8. The connector of claim 5, wherein, when the insert is in the partially inserted position and the cover is in the fully plugged position, the insert is configured such that the second terminal is engaged with the first terminal.

9. The connector of claim 5, wherein the inner surface further having a second tapered portion.

10. The connector of claim 9, wherein when the insert is in the fully inserted position and the cover is in the fully plugged position, the connector is configured such that the second terminal engages with the second tapered portion to compress the second terminal into the first terminal.

11. A method, comprising:

providing, in a receptacle of a connector system, a first terminal of a first gender;

plugging a cover of the connector system into the receptacle inserting an insert of the connector system into the cover, the insert including a second terminal of a second gender opposite to the first gender, and the insert being separate from the cover and from the receptacle, wherein, in inserting the insert into the cover, the first terminal makes an electrical connection with the second terminal.

12. The method of claim 11, wherein the cover is configured to plug into the receptacle in a partially plugged position and in a fully plugged position.

13. The method of claim 12, further comprising:

plugging the cover into the receptacle in the partially plugged position, wherein, when the cover is plugged into the receptacle in the partially plugged position, the cover engages with the first terminal to align the cover with the first terminal.

14. The method of claim 13, wherein the insert is further configured to insert into the cover in a partially inserted position and in a fully inserted position.

15. The method of claim 14, wherein the cover includes an inner surface having a first tapered portion to align the second terminal with the first terminal.

16. The method of claim 15, further comprising:

inserting the insert into the cover in the partially inserted position, wherein when the insert is inserted into the cover in the partially inserted position, the insert engages with the first tapered portion to align the second terminal with the first terminal.

17. The method of claim 15, further comprising:

inserting the insert into the cover in the partially inserted position, wherein when the insert is inserted into the cover in the partially inserted position, the insert engages with the first tapered portion to correct at least one of a deformed first terminal and a deformed second terminal.

18. The method of claim 15, wherein the inner surface further having a second tapered portion.

19. The method of claim 18, further comprising:

inserting the insert into the cover in the fully inserted position, wherein when the insert is inserted into the cover in the fully inserted position, connector is configured such that the second terminal engages with the second tapered portion to compress the second terminal into the first terminal.

20. A connector plug for an electrical connector, the plug comprising:

a cover configured to plug into a receptacle of the electrical connector, the receptacle including a first terminal of a first gender; and an insert configured to plug into the cover, the insert being separate from the cover and including a second terminal of a second gender opposite to the first gender, wherein, when the insert is inserted into the cover, the first terminal makes an electrical connection with the second terminal.

* * * * *